United States Patent [19]

Aldag, Jr. et al.

[11] Patent Number: 4,775,652

[45] Date of Patent: Oct. 4, 1988

[54] HYDROFINING COMPOSITION

[75] Inventors: Arthur W. Aldag, Jr., Bartlesville, Okla.; Simon G. Kukes, Naperville, Ill.; Stephen L. Parrott, Bartlesville, Okla.

[73] Assignee: Phillips Petroleum Company, Bartlesville, Okla.

[21] Appl. No.: 135,904

[22] Filed: Dec. 21, 1987

Related U.S. Application Data

[62] Division of Ser. No. 887,689, Jul. 21, 1986, Pat. No. 4,728,417.

[51] Int. Cl.[4] ..... B01J 31/22

[52] U.S. Cl. ..... 502/162; 502/167; 502/168; 502/170

[58] Field of Search ..... 502/162, 167, 168, 170

[56] References Cited

U.S. PATENT DOCUMENTS

| | | | |
|---|---|---|---|
| 4,399,024 | 8/1983 | Fukui et al. | 208/131 |
| 4,560,468 | 12/1985 | Kukes et al. | 208/110 |
| 4,564,441 | 1/1986 | Kukes et al. | 208/108 |
| 4,578,180 | 3/1986 | Kukes et al. | 208/110 |
| 4,608,152 | 8/1986 | Howell et al. | 208/108 |
| 4,612,110 | 9/1986 | Kukes et al. | 208/251 H |
| 4,705,766 | 11/1987 | Howell et al. | 502/167 |
| 4,728,417 | 3/1988 | Aldag et al. | 206/216 R |

*Primary Examiner*—Asok Pal

*Attorney, Agent, or Firm*—Williams, Phillips & Umphlett

[57] ABSTRACT

An additive comprising a mixture of at least one decomposable molybdenum compound selected from the group consisting of molybdenum dithiophosphates and molybdenum dithiocarbamates and at least one decomposable nickel compound selected from the group consisting of nickel dithiophosphates and nickel dithiocarbamates is mixed with a hydrocarbon-containing feed stream. The hydrocarbon-containing feed stream containing the additive is then contacted in a hydrofining process with a catalyst composition comprising a support selected from the group consisting of alumina, silica and silica-alumina and a promoter comprising at least one metal selected from Group VIB, Group VIIB and Group VIII of the Periodic Table. The introduction of the inventive additive may be commenced when the catalyst is new, partially deactivated or spent with a beneficial result occuring in each case.

15 Claims, No Drawings

HYDROFINING COMPOSITION

This application is a division of application Ser. No. 887,689, filed July 18, 1986, now U.S. Pat. No. 4,728,417.

This invention relates to a hydrofining process for hydrocarbon-containing feed streams. In one aspect, this invention relates to a process for removing metals from a hydrocarbon-containing feed stream. In another aspect, this invention relates to a process for removing sulfur or nitrogen from a hydrocarbon-containing feed stream. In still another aspect, this invention relates to a process for removing potentially cokeable components from a hydrocarbon-containing feed stream. In still another aspect, this invention relates to a process for reducing the amount of heavies in a hydrocarbon-containing feed stream.

It is well known that crude oil as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur and nitrogen is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur and nitrogen and components which have a tendency to produce coke.

It is also desirable to reduce the amount of heavies in the heavier fractions such as the topped crude and residuum. As used herein the term heavies refers to the fraction having a boiling range higher than about 1000° F. This reduction results in the production of lighter components which are of higher value and which are more easily processed.

It is thus an object of this invention to provide a process to remove components such as metals, sulfur, nitrogen and Ramsbottom carbon residue from a hydrocarbon-containing feed stream and to reduce the amount of heavies in the hydrocarbon-containing feed stream (one or all of the described removals and reduction may be accomplished in such process, which is generally refered to as a hydrofining process, depending upon the components contained in the hydrocarbon-containing feed stream). Such removal or reduction provides substantial benefits in the subsequent processing of the hydrocarbon-containing feed streams.

In accordance with the present invention, a hydrocarbon-containing feed stream, which also contains metals (such as vanadium, nickel, iron), sulfur, nitrogen and/or Ramsbottom carbon residue, is contacted with a solid catalyst composition comprising alumina, silica or silica-alumina. The catalyst composition also contains at least one metal selected from Group VIB, Group VIIB, and Group VIII of the Periodic Table, in the oxide or sulfide form. An additive comprising a mixture of at least one decomposable molybdenum compound selected from the group consisting of molybdenum dithiophosphates and molybdenum dithiocarbamates and at least one decomposable nickel compound selected from the group consisting of nickel dithiophosphates and nickel dithiocarbamates is mixed with the hydrocarbon-containing feed stream prior to contacting the feed stream with the catalyst composition. The hydrocarbon-containing feed stream, which also contains the additive, is contacted with the catalyst composition in the presence of hydrogen under suitable hydrofining conditions. After being contacted with the catalyst composition, the hydrocarbon-containing feed stream will contain a significantly reduced concentration of metals, sulfur, nitrogen and Ramsbottom carbon residue as well as a reduced amount of heavy hydrocarbon components. Removal of these components from the hydrocarbon-containing feed stream in this manner provides an improved processability of the hydrocarbon-containing feed stream in processes such as catalytic cracking, hydrogenation or further hydrodesulfurization. Use of the inventive additive results in improved removal of metals, primarily vanadium and nickel.

The additive of the present invention may be added when the catalyst composition is fresh or at any suitable time thereafter. As used herein, the term 'fresh catalyst' refers to a catalyst which is new or which has been reactivated by known techniques. The activity of fresh catalyst will generally decline as a function of time if all conditions are maintained constant. It is believed that the introduction of the inventive additive will slow the rate of decline from the time of introduction and in some cases will dramatically improve the activity of an at least partially spent or deactivated catalyst from the time of introduction.

For economic reasons it is sometimes desirable to practive the hydrofining process without the addition of the additive of the present invention until the catalyst activity declines below an acceptable level. In some cases, the activity of the catalyst is maintained constant by increasing the process temperature. The inventive additive is added after the activity of the catalyst has dropped to an unacceptable level and the temperature cannot be raised further without adverse consequences. It is believed that the addition of the inventive additive at this point will result in a dramatic increase in catalyst activity based on the results set forth in Example IV.

Other objects and advantages of the invention will be apparent from the foregoing brief description of the invention and the appended claims as well as the detailed description of the invention which follows.

The catalyst composition used in the hydrofining process to remove metals, sulfur, nitrogen and Ramsbottom carbon residue and to reduce the concentration of heavies comprises a support and a promoter. The support comprises alumina, silica or silica-alumina. Suitable supports are believed to be $Al_2O_3$, $SiO_2$, $Al_2O_3$—$SiO_2$, $Al_2O_3$—$TiO_2$, $Al_2O_3$—$BPO_4$, $Al_2O_3$—$AlPO_4$, $Al_2O_3$—$Zr_3(PO_4)_4$, $Al_2O_3$—$SnO_2$ and $Al_2O_3$—$ZnO_2$. Of these supports, $Al_2O_3$ is particularly preferred.

The promoter comprises at least one metal selected from the group consisting of the metals of Group VIB, Group VIIB, and Group VIII of the Periodic Table. The promoter will generally be present in the catalyst composition in the form of an oxide or sulfide. Particularly suitable promoters are iron, cobalt, nickel, tungsten, molybdenum, chromium, manganese, vanadium and platinum. Of these promoters, cobalt, nickel, molybdenum and tungsten are the most preferred. A particularly preferred catalyst composition is $Al_2O_3$ promoted by CoO and $MoO_3$ or promoted by CoO, NiO and $MoO_3$.

Generally, such catalysts are commercially available. The concentration of cobalt oxide in such catalysts is typically in the range of about 0.5 weight percent to about 10 weight percent based on the weight of the total catalyst composition. The concentration of molybdenum oxide is generally in the range of about 2 weight percent to about 25 weight percent based on the weight of the total catalyst composition. The concentration of nickel oxide in such catalysts is typically in the range of about 0.3 weight percent to about 10 weight percent based on the weight of the total catalyst composition. Pertinent properties of four commercial catalysts which are believed to be suitable are set forth in Table I.

TABLE I

| Catalyst | CoO (Wt. %) | MoO (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commercial Catalyst D Harshaw Chemical Company | 0.92 | 7.3 | 0.53 | — | 178 |

*Measured on 20/40 mesh particles, compacted.

The catalyst composition can have any suitable surface area and pore volume. In general, the surface area will be in the range of about 2 to about 400 $m^2/g$, preferably about 100 to about 300 $m^2/g$, while the pore volume will be in the range of about 0.1 to about 4.0 cc/g, preferably abut 0.3 to about 1.5 cc/g.

Presulfiding of the catalyst is preferred before the catalyst is initially used. Many presulfiding procedures are known and any conventional presulfiding procedure can be used. A preferred presulfiding procedure is the following two step procedure.

The catalyst is first treated with a mixture of hydrogen sulfide in hydrogen at a temperature in the range of about 175° C. to about 225° C., preferably about 205° C. The temperature in the catalyst composition will rise during this first presulfiding step and the first presulfiding step is continued until the temperature rise in the catalyst has substantially stopped or until hydrogen sulfide is detected in the effluent flowing from the reactor. The mixture of hydrogen sulfide and hydrogen preferably contains in the range of about 5 to about 20 percent hydrogen sulfide, preferably about 10 percent hydrogen sulfide.

The second step in the preferred presulfiding process consists of repeating the first step at a temperature in the range of about 350° C. to about 400° C., preferably about 370° C., for about 2–3 hours. It is noted that other mixtures containing hydrogen sulfide may be utilized to presulfide the catalyst. Also the use of hydrogen sulfide is not required. In a commercial operation, it is common to utilize a light naphtha containing sulfur to presulfide the catalyst.

As has been previously stated, the present invention may be practiced when the catalyst is fresh or the addition of the inventive additive may be commenced when the catalyst has been partially deactivated. The addition of the inventive additive may be delayed until the catalyst is considered spent.

In general, a "spent catalyst" refers to a catalyst which does not have sufficient activity to produce a product which will meet specifications, such as maximum permissible metals content, under available refinery conditions. For metals removal, a catalyst which removes less than about 50% of the metals contained in the feed is generally considered spent.

A spent catalyst is also sometimes defined in terms of metals loading (nickel+vanadium). The metals loading which can be tolerated by different catalyst varies but a catalyst whose weight has increased at least about 15% due to metals (nickel+vanadium) is generally considered a spent catalyst.

Any suitable hydrocarbon-containing feed stream may be hydrofined using the above described catalyst composition in accordance with the present invention. Suitable hydrocarbon-containing feed streams include petroleum products, coal, pyrolyzates, products from extraction and/or liquefaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes and residuum and other materials which are generally regarded as too heavy to be distilled. These materials will generally contain the highest concentrations of metals, sulfur, nitrogen and Ramsbottom carbon residues.

It is believed that the concentration of any metal in the hydrocarbon-containing feed stream can be reduced using the above described catalyst composition in accordance with the present invention. However, the present invention is particularly applicable to the removal of vanadium, nickel and iron.

The sulfur which can be removed using the above described catalyst composition in accordance with the present invention will generally be contained in organic sulfur compounds. Examples of such organic sulfur compounds include sulfides, disulfides, mercaptans, thiophenes, benzylthiophenes, dibenzylthiophenes, and the like.

The nitrogen which can be removed using the above described catalyst composition in accordance with the present invention will also generally be contained in organic nitrogen compounds. Examples of such organic nitrogen compounds include amines, diamines, pyridines, quinolines, porphyrins, benzoquinolines and the like.

While the above described catalyst composition is effective for removing some metals, sulfur, nitrogen and Ramsbottom carbon residue, the removal of metals can be significantly improved in accordance with the present invention by introducing an additive comprising a mixture of at least one decomposable molybdenum compound selected from the group consisting of molybdenum dithiophosphates and molybdenum dithiocarbamates and at least one decomposable nickel compound selected from the group consisting of nickel dithiophosphates and nickel dithiocarbamates into the hydrocarbon-containing feed stream prior to contacting the feed stream with the catalyst composition. As has been previously stated, the introduction of the inventive additive may be commenced when the catalyst is new, partially deactivated or spent with a beneficial result occurring in each case.

Any suitable decomposable molybdenum dithiophosphate compound may be used in the additive of the present invention. Generic formulas of suitable molybdenum dithiophosphates are:

$$Mo(S-\overset{\overset{S}{\|}}{\underset{\underset{OR_1}{|}}{P}}-OR_2)_n \quad (1)$$

wherein n=3,4,5,6; $R_1$ and $R_2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or $R_1$ and $R_2$ are combined in one alkylene group of the structure

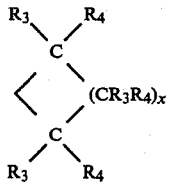

with $R_3$ and $R_4$ being independently selected from H, alkyl, cycloalkyl, alkylcycloalkyl and aryl, alkylaryl and cycloalkylaryl groups as defined above, and x ranging from 1 to 10;

$$MoO_pS_q(S-\overset{\overset{S}{\|}}{\underset{\underset{OR_1}{|}}{P}}-OR_2)_r \quad (2)$$

wherein
p=0,1,2;q=0,1,2; (p+q)=1,2;
r=1,2,3,4 for (p+q)=1 and
r=1,2 for (p+q)=2;

$$Mo_2O_tS_u(S-\overset{\overset{S}{\|}}{\underset{\underset{OR_1}{|}}{P}}-OR_2)_v \quad (3)$$

wherein
t=0,1,2,3,4;u=0,1,2,3,4;
(t+u)=1,2,3,4
v=4,6,8,10 for (t+u)=1;v=2,4,6,8 for (t+u)=2;
v=2,4,6, for (t+u)=3,v=2,4 for (t+u)=4.

Sulfurized oxomolybdenum (V) O,O'-di)2-ethylhexyl)-phosphorodithioate of the formula $Mo_2S_2O_2[S_2P(OC_8H_{17})_2]$ is a particularly preferred molybdenum dithiophosphate.

Any suitable molybdenum dithiocarbamate compound may be used in the additive of the present invention. Generic formulas of suitable molybdenum (III), (IV), (V) and (VI) dithiocarbamates are:

$$[Mo(S-\overset{\overset{S}{\|}}{C}-NR_1R_2)_n]_m, \quad (4)$$

wherein n=3,4,5,6;m=1,2; $R_1$ and $R_2$ are either independently selected from H, alkyl groups having 1–20 carbon atoms, cycloalkyl groups having 3–22 carbon atoms and aryl groups having 6–25 carbon atoms; or $R_1$ and $R_2$ are combined in one alkylene group of the structure

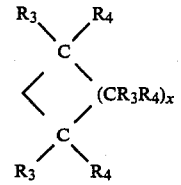

with $R_3$ and $R_4$ being independently selected from H, alkyl, cycloalkyl and aryl groups as defined above, and x ranging from 1 to 10;

$$MoO_pS_q(S-\overset{\overset{S}{\|}}{C}-NR_1R_2)_r \quad (5)$$

wherein
p=0,1,2;q=0,1,2; (p+q)=1,2;
r=1,2,3,4, for (p+q)=1 and
r=1,2 for (p+q)=2;

$$Mo_2O_tS_u(S-\overset{\overset{S}{\|}}{C}-NR_1R_2)_v \quad (6)$$

wherein
t=0,1,2,3,4;u=0,1,2,3,4;
(t+u)=1,2,3,4
v=4,6,8,10 for (t+u)=1;v=2,4,6,8 for (t+u)=2;
v=2,4,6 for (t+u)=3,v=2,4 for (t+u)=4.

Molybdenum(V) di(tridecyl)dithiocarbamate is a particularly preferred molybdenum dithiocarbamate.

Any suitable decomposable nickel dithiophosphate compound may be used in the additive of the present invention. Suitable nickel dithiophosphates are those having the generic formula:

$$Ni(S-\overset{\overset{S}{\|}}{\underset{\underset{OR_1}{|}}{P}}-OR_2)_2$$

wherein $R_1$ and $R_2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or $R_1$ and $R_2$ are combined in one alkylene group of the structure

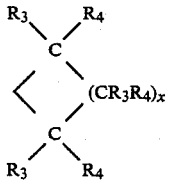

with $R_3$ and $R_4$ being independently selected from H, alkyl, cycloalkyl, alkylcycloalkyl and aryl, alkylaryl and cycloalkylaryl groups as defined above, and x ranging from 1 to 10. Nickel (II) O,O'-diamylphosphorodithioate and nickel (II) O,O'-dioctylphosphorodithioate are particularly preferred nickel dithiophosphates.

Any suitable nickel dithiocarbamate compound may be used in the additive of the present invention. Suitable nickel dithiocarbamates are those having the generic formula:

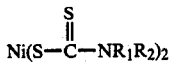

wherein $R_1$ and $R_2$ are either independently selected from H, alkyl groups having 1–20 carbon atoms, cycloalkyl groups having 3–22 carbon atoms and aryl groups having 6–25 carbon atoms; or $R_1$ and $R_2$ are combined in one alkylene group of the structure

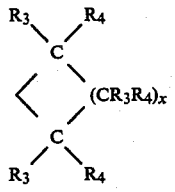

with $R_3$ and $R_4$ being independently selected from H, alkyl, cycloalkyl and aryl groups as defined above, and x ranging from 1 to 10. Nickel (II) diamyldithiocarbamate of the formula $Ni[S_2CN(C_5H_{11})_2]_2$ is a particularly preferred nickel dithiocarbamate.

The decomposable molybdenum compounds and decomposable nickel compounds may be present in the mixed additive of the present invention in any suitable amounts. In general, the atomic ratio of the molybdenum compounds to the nickel compounds will be in the range of about 1:1 to about 10:1, and will more preferably be about 4:1.

Any suitable concentration of the inventive additive may be added to the hydrocarbon-containing feed stream. In general, a sufficient quantity of the additive will be added to the hydrocarbon-containing feed stream to result in a concentration of molybdenum metal in the range of about 1 to about 60 ppm and more preferably in the range of about 2 to about 30 ppm.

High concentrations such as about 100 ppm and above should be avoided to prevent plugging of the reactor. It is noted that one of the particular advantages of the present invention is the very small concentrations of molybdenum which result in a significant improvement. This substantially improves the economic viability of the process.

After the inventive additive has been added to the hydrocarbon-containing feed stream for a period of time, it is believed that only periodic introduction of the additive is required to maintain the efficiency of the process.

The inventive additive may be combined with the hydrocarbon-containing feed stream in any suitable manner. The additive may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting the additive into the hydrocarbon-containing feed stream is sufficient. No special mixing equipment or mixing period are required.

The pressure and temperature at which the inventive additive is introduced into the hydrocarbon-containing feed stream is not thought to be critical. However, a temperature below 450° C. is recommended.

The hydrofining process can be carried out by means of any apparatus whereby there is achieved a contact of the catalyst composition with the hydrocarbon-containing feed stream and hydrogen under suitable hydrofining conditions. The hydrofining process is in no way limited to the use of a particular apparatus. The hydrofining process can be carried out using a fixed catalyst bed, fluidized catalyst bed or a moving catalyst bed. Presently preferred is a fixed catalyst bed.

Any suitable reaction time between the catalyst composition and the hydrocarbon-containing feed stream may be utilized. In general, the reaction time will range from about 0.1 hours to about 10 hours. Preferably, the reaction time will range from about 0.3 to about 5 hours. Thus, the flow rate of the hydrocarbon-containing feed stream should be such that the time required for the passage of the mixture through the reactor (residence time) will preferably be in the range of about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The hydrofining process can be carried out at any suitable temperature. The temperature will generally be in the range of about 150° C. to about 550° C. and will preferably be in the range of about 340° to about 440° C. Higher temperatures do improve the removal of metals but temperatures should not be utilized which will have adverse effects on the hydrocarbon-containing feed stream, such as coking, and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to abut 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the catalyst composition is utilized until a satisfactory level of metals removal fails to be achieved which is believed to result from the coating of the catalyst composition with the metals being removed. It is possible to remove the metals from the catalyst composition by certain leaching procedures but these procedures are expensive and it is generally contemplated that once the removal of metals falls below a desired level, the used catalyst will simply be replaced by a fresh catalyst.

The time in which the catalyst composition will maintain its activity for removal of metals will depend upon the metals concentration in the hydrocarbon-containing feed streams being treated. It is believed that the catalyst composition may be used for a period of time long enough to accumulate 10–200 weight percent of metals, mostly Ni, V, and Fe, based on the weight of the catalyst composition, from oils.

The following examples are presented in further illustration of the invention.

EXAMPLE I

In this example, the process and apparatus used for hydrofining heavy oils in accordance with the present invention is described. Oil, with or without decomposable additives, was pumped downward through an induction tube into a trickle bed reactor which was 28.5 inches long and 0.75 inches in diameter. The oil pump used was a Whitey Model LP 10 (a reciprocating pump with a diaphragm-sealed head; marketed by Whitey Corp., Highland Heights, Ohio). The oil induction tube extended into a catalyst bed (located about 3.5 inches below the reactor top) comprising a top layer of about 40 cc of low surface area α-alumina (14 grit Alundum; surface area less than 1 m2/gram; marketed by Norton Chemical Process Products, Akron, Ohio), a middle layer of 33.3 cc of a hydrofining catalyst, mixed with 85 cc of 36 grit Alundum and a bottom layer of about 30 cc of α-alumina.

The hydrofining catalyst used was a fresh, commercial, promoted desulfurization catalyst (referred to as catalyst D in table I) marketed by Harshaw Chemical Company, Beachwood, Ohio. The catalyst had an $Al_2O_3$ support having a surface area of 178 $m^2/g$ (determined by BET method using $N_2$ gas), a medium pore diameter of 140 Å and a total pore volume of 0.682 cc/g (both determined by mercury porosimetry in accordance with the procedure described by American Instrument Company, Silver Springs, Md., catalog number 5- 7125-13). The catalyst contained 0.92 wt-% Co (as cobalt oxide), 0.53 weight-% Ni (as nickel oxide); 7.3 wt-% Mo (as molybdenum oxide).

The catalyst was presulfided as follows. A heated tube reactor was filled with an 8 inch high bottom layer of Alundum, a 7–8 inch high middle layer of catalyst D, and an 11 inch top layer of Alundum. The reactor was purged with nitrogen and then the catalyst was heated for one hour in a hydrogen stream to about 400° F. While the reactor temperature was maintained at about 400° F., the catalyst was exposed to a mixture of hydrogen (0.46 scfm) and hydrogen sulfide (0.049 scfm) for about two hours. The catalyst was then heated for about one hour in the mixture of hydrogen and hydrogen sulfide to a temperatue of about 700° F. The reactor temperature was then maintained at 700° F. for two hours while the catalyst continued to be exposed to the mixture of hydrogen and hydrogen sulfide. The catalyst was then allowed to cool to ambient temperature conditions in the mixture of hydrogen and hydrogen sulfide and was finally purged with nitrogen.

Hydrogen gas was introduced into the reactor through a tube that concentrically surrounded the oil induction tube but extended only as far as the reactor top. The reactor was heated with a Thermcraft (Winston-Salem, N.C.) Model 211 3-zone furnace. The reactor temperature was measured in the catalyst bed at three different locations by three separate thermocouples embedded in an axial thermocouple well (0.25 inch outer diameter). The liquid product oil was generally collected every day for analysis. The hydrogen gas was vented. Vanadium and nickel contents were determined by plasma emission analysis; sulfur content was measured by X-ray fluorescence spectrometry; Ramsbottom carbon residue was determined in accordance with ASTM D524; pentane insolubles were measured in accordance with ASTM D893; and nitrogen content was measured in accordance with ASTM D3228.

The additives used were mixed in the feed by adding a desired amount to the oil and then shaking and stirring the mixture. The resulting mixture was supplied through the oil induction tube to the reactor when desired.

EXAMPLE II

A desalted, topped (400° F.+) Maya heavy crude (density at 60° F.: 0.9569 g/cc) was hydrotreated in accordance with the procedure described in Example I. The hydrogen feed rate was about 2,500 standard cubic feet (SCF) of hydrogen per barrel of oil; the temperature was about 750° F.; and the pressure was about 2250 psig. The results received from the test were corrected to reflect a standard liquid hourly space velocity (LHSV) for the oil of about 1.0 cc/cc catalyst/hr. The molybdenum compound added to the feed in run 2 was Molyvan® L, an antioxidant and antiwear lubricant additive marketed by R. T. Vanderbilt Company, Norwalk, CT. Molyvan® L is a mixture of about 80 weight-% of a sulfurized oxy-molybdenum (V) dithiophosphate of the formula $Mo_2S_2O_2[PS_2(OR)_2]$, wherein R is the 2-ethylhexyl group, and about 20 weight-% of an aromatic petroleum oil (Flexon 340; specific gravity: 0.963; viscosity at 210° F.: 38.4 SUS; marketed by Exxon Company U.S.A., Houston, TX). The nickel compound added to the feed in run 3 was a nickel dithiophosphate (OD-843; marketed by R. T. Vanderbilt Company, Norwalk, CT.) The composition added to the feed in run 4 was a mixture of Molyvan® L and OD-843 containing 20.6 ppm molybdenum and 4.4 ppm nickel. The results of these tests are set forth in Table II.

TABLE II

| | | | PPM in Feed | | | | | | | | |
|---|---|---|---|---|---|---|---|---|---|---|---|
| | Hours on | Temp | Added | | | | | PPM in Product | | | % Removal |
| Run | Stream | (°F.) | Mo | Ni | Ni | V | Ni + V | Ni | V | Ni + V | of (Ni + V) |
| 1 | 30 | 750 | 0 | 0 | 65 | 338 | 403 | 19 | 61 | 80 | 80 |
| (Control) | 54 | 750 | 0 | 0 | 65 | 338 | 403 | 23 | 76 | 99 | 75 |
| No Additive | 78 | 750 | 0 | 0 | 65 | 338 | 403 | 22 | 73 | 95 | 76 |
| | 102 | 750 | 0 | 0 | 65 | 338 | 403 | 24 | 79 | 103 | 74 |
| | 126 | 750 | 0 | 0 | 65 | 338 | 403 | 24 | 83 | 107 | 73 |
| | 150 | 750 | 0 | 0 | 65 | 338 | 403 | 27 | | | |
| | 174 | 750 | 0 | 0 | 65 | 338 | 403 | 26 | 79 | 105 | 74 |
| | 198 | 750 | 0 | 0 | 65 | 338 | 403 | 25 | 76 | 101 | 75 |
| | 222 | 750 | 0 | 0 | 65 | 338 | 403 | 27 | 79 | 106 | 74 |
| | 246 | 750 | 0 | 0 | 65 | 338 | 403 | 27 | 80 | 107 | 73 |
| | 270 | 750 | 0 | 0 | 65 | 338 | 403 | 31 | 94 | 125 | 69 |
| | 294 | 750 | 0 | 0 | 65 | 338 | 403 | 28 | 88 | 116 | 71 |
| | 296 | 750 | 0 | 0 | 65 | 338 | 403 | | | | |

TABLE II-continued

| Run | Hours on Stream | Temp (°F.) | PPM in Feed Added Mo | Ni | Ni | V | Ni + V | PPM in Product Ni | V | Ni + V | % Removal of (Ni + V) |
|---|---|---|---|---|---|---|---|---|---|---|---|
| | 321 | 750 | 0 | 0 | 65 | 338 | 403 | 24 | 73 | 97 | 76 |
| | 345 | 750 | 0 | 0 | 65 | 338 | 403 | 27 | 92 | 119 | 71 |
| | 369 | 750 | 0 | 0 | 65 | 338 | 403 | 24 | 78 | 102 | 75 |
| | 393 | 750 | 0 | 0 | 65 | 338 | 403 | 27 | 94 | 121 | 70 |
| 2 | 31 | 750 | 19 | 0 | 65 | 338 | 403 | 28 | 94 | 122 | 70 |
| (Control) | 55 | 750 | 19 | 0 | 65 | 338 | 403 | 25 | 82 | 107 | 73 |
| Mo Added | 79 | 750 | 19 | 0 | 65 | 338 | 403 | 28 | 106 | 134 | 67 |
| | 103 | 750 | 19 | 0 | 65 | 338 | 403 | 27 | 89 | 116 | 71 |
| | 127 | 750 | 19 | 0 | 65 | 338 | 403 | 24 | 75 | 99 | 75 |
| | 151 | 750 | 19 | 0 | 65 | 338 | 403 | 25 | 82 | 107 | 73 |
| | 175 | 750 | 19 | 0 | 65 | 338 | 403 | 29 | 97 | 126 | 69 |
| | 199 | 750 | 19 | 0 | 65 | 338 | 403 | 25 | 73 | 98 | 76 |
| | 223 | 750 | 19 | 0 | 65 | 338 | 403 | 24 | 78 | 102 | 75 |
| | 247 | 750 | 19 | 0 | 65 | 338 | 403 | 21 | 68 | 89 | 78 |
| | 271 | 750 | 19 | 0 | 65 | 338 | 403 | 21 | 67 | 88 | 78 |
| | 295 | 750 | 19 | 0 | 65 | 338 | 403 | 23 | 56 | 79 | 80 |
| | 319 | 750 | 19 | 0 | 65 | 338 | 403 | 23 | 70 | 93 | 77 |
| | 343 | 750 | 19 | 0 | 65 | 338 | 403 | 26 | 80 | 106 | 74 |
| 3 | 31 | 750 | 0 | 23 | 65 | 338 | 426 | 17 | 57 | 74 | 83 |
| (Control) | 55 | 750 | 0 | 23 | 65 | 338 | 426 | 21 | 70 | 91 | 79 |
| Ni Added | 79 | 750 | 0 | 23 | 65 | 338 | 426 | 23 | 73 | 96 | 77 |
| | 103 | 750 | 0 | 23 | 65 | 338 | 426 | 22 | 76 | 98 | 77 |
| | 127 | 750 | 0 | 23 | 65 | 338 | 426 | 25 | 88 | 113 | 74 |
| | 151 | 750 | 0 | 23 | 65 | 338 | 426 | 26 | 95 | 121 | 71 |
| | 175 | 750 | 0 | 23 | 65 | 338 | 426 | 27 | 104 | 131 | 69 |
| | 199 | 750 | 0 | 23 | 65 | 338 | 426 | 24 | 87 | 111 | 74 |
| | 223 | 750 | 0 | 23 | 65 | 338 | 426 | 26 | 93 | 119 | 72 |
| | 247 | 750 | 0 | 23 | 65 | 338 | 426 | 25 | 86 | 111 | 74 |
| | 271 | 750 | 0 | 23 | 65 | 338 | 426 | 29 | 95 | 124 | 71 |
| | 295 | 750 | 0 | 23 | 65 | 338 | 426 | 29 | 110 | 139 | 67 |
| | 319 | 750 | 0 | 23 | 65 | 338 | 426 | 29 | 109 | 138 | 68 |
| | 363 | 750 | 0 | 23 | 65 | 338 | 426 | 30 | 103 | 133 | 69 |
| | 387 | 750 | 0 | 23 | 65 | 338 | 426 | 35 | 139 | 174 | 59 |
| | 411 | 750 | 0 | 23 | 65 | 338 | 426 | 34 | 113 | 147 | 66 |
| 4 | 31 | 750 | 17 | 5 | 65 | 327 | 397 | 15 | 38 | 53 | 87 |
| (Invention) | 55 | 750 | 17 | 5 | 65 | 327 | 397 | 18 | 46 | 64 | 84 |
| Mo + Ni | 79 | 750 | 17 | 5 | 65 | 327 | 397 | 19 | 49 | 68 | 83 |
| Added | 103 | 750 | 17 | 5 | 65 | 327 | 397 | 18 | 51 | 69 | 83 |
| | 127 | 750 | 17 | 5 | 65 | 327 | 397 | 19 | 52 | 71 | 82 |
| | 151 | 750 | 17 | 5 | 65 | 327 | 397 | 20 | 52 | 72 | 82 |
| | 175 | 750 | 17 | 5 | 65 | 327 | 397 | 20 | 54 | 74 | 81 |
| | 199 | 750 | 17 | 5 | 65 | 327 | 397 | 19 | 52 | 71 | 82 |
| | 223 | 750 | 17 | 5 | 65 | 327 | 397 | 19 | 54 | 73 | 82 |
| | 247 | 750 | 17 | 5 | 65 | 327 | 397 | 20 | 52 | 72 | 82 |
| | 271 | 750 | 17 | 5 | 65 | 327 | 397 | 24 | 68 | 92 | 77 |
| | 295 | 750 | 17 | 5 | 65 | 327 | 397 | 22 | 59 | 81 | 80 |
| | 319 | 750 | 17 | 5 | 65 | 327 | 397 | 23 | 61 | 84 | 79 |
| | 343 | 750 | 17 | 5 | 65 | 327 | 397 | 24 | 66 | 90 | 77 |

The data in Table II shows that the additive containing a mixture of a molybdenum dithiophosphate and a nickel dithiophosphate was a more effective demetallizing agent than either the molybdenum dithiophosphate or the nickel dithiophosphate alone. Based upon these results, it is believed that a mixed additive containing either a molybdenum dithiocarbamate or a nickel dithiocarbamate (or both) in the inventive mixture would also be an effective demetallizing agent.

EXAMPLE III

This example demonstrates the removal of other undesirable impurities found in heavy oil. In this example, a Hondo Californian heavy crude was hydrotreated in accordance with the procedure described in Example II, except that the liquid hourly space velocity (LHSV) of the oil was maintained at about 1.5 cc/cc catalyst/hr. The molybdenum compound added to the feed in run 2 was Molyvan® L. The results of these tests are set forth in Table III. The listed weight percentages of sulfur, Ramsbottom carbon residue, pentane insolubles and nitrogen in the product were the lowest and highest values measured during the entire run times (run 1: about 24 days; run 2: about 11 days).

TABLE III

| | Run 1 No Additive (Control) | Run 2 Molyvan® L (Comparative) |
|---|---|---|
| Wt % in Feed: | | |
| Sulfur | 5.6 | 5.3 |
| Carbon Residue | 9.9 | 9.8 |
| Pentane Insolubles | 13.4 | 12.2 |
| Nitrogen | 0.70 | 0.73 |
| Wt % in Product: | | |
| Sulfur | 1.5–3.0 | 1.3–1.7 |
| Carbon Residue | 6.6–7.6 | 4.8–5.6 |
| Pentane Insolubles | 4.9–6.3 | 2.2–2.3 |
| Nitrogen | 0.60–0.68 | 0.51–0.60 |
| % Removal of: | | |
| Sulfur | 46–73 | 68–75 |
| Carbon Residue | 23–33 | 43–51 |
| Pentane Insolubles | 53–63 | 81–82 |
| Nitrogen | 3–14 | 18–30 |

The data in Table III shows that the removal of sulfur, carbon residue, pentane insolubles and nitrogen was consistently higher in run 2 (with Molyvan ® L) than in run 1 (with no added Mo). Based upon this data and the data set forth in Table II, it is believed that the addition of the inventive additive to a hydrocarbon-containing feed stream would also be beneficial in enhancing the removal of undesirable impurities from such feed streams.

EXAMPLE IV

This example compares the demetallization activity of two decomposable molybdenum additives. In this example, a Hondo Californian heavy crude was hydrotreated in accordance with the procedure described in Example II, except that the liquid hourly space velocity (LHSV) of the oil was maintained at about 1.5 cc/cc catalyst/hr. The molybdenum compound added to the feed in run 1 was $Mo(CO)_6$ (marketed by Aldrich Chemical Company, Milwaukee, Wis.). The molybdenum compound added to the feed in run 2 was Molyvan ® L. The results of these tests are set forth in Table IV.

TABLE IV

| Run | Days on Stream | Temp (°F.) | PPM in Feed Added Mo | Ni | Ni | V | Ni + V | PPM in Product Ni | V | Ni + V | % Removal of (Ni + V) |
|---|---|---|---|---|---|---|---|---|---|---|---|
| 1 | 1 | 750 | 20 | 0 | 103 | 248 | 351 | 22 | 38 | 60 | 83 |
| (Control) | 1.5 | 750 | 20 | 0 | 103 | 248 | 351 | 25 | 42 | 67 | 81 |
| $Mo(CO)_6$ | 2.5 | 750 | 20 | 0 | 103 | 248 | 351 | 28 | 42 | 70 | 80 |
| Added | 3.5 | 750 | 20 | 0 | 103 | 248 | 351 | 19 | 35 | 54 | 85 |
| | 6 | 750 | 20 | 0 | 103 | 248 | 351 | 29 | 38 | 67 | 81 |
| | 7 | 750 | 20 | 0 | 103 | 248 | 351 | 25 | 25 | 50 | 86 |
| | 8 | 750 | 20 | 0 | 103 | 248 | 351 | 27 | 35 | 62 | 82 |
| | 9 | 750 | 20 | 0 | 103 | 248 | 351 | 27 | 35 | 62 | 82 |
| | 10 | 750 | 20 | 0 | 103 | 248 | 351 | 32 | 35 | 67 | 81 |
| | 11 | 750 | 20 | 0 | 103 | 248 | 351 | 25 | 35 | 60 | 83 |
| | 12 | 750 | 20 | 0 | 103 | 248 | 351 | 27 | 34 | 61 | 83 |
| | 13 | 750 | 20 | 0 | 103 | 248 | 351 | 31 | 35 | 66 | 81 |
| | 14 | 750 | 20 | 0 | 103 | 248 | 351 | 36 | 52 | 88 | 75 |
| | 15 | 750 | 20 | 0 | 103 | 248 | 351 | 47 | 68 | 115 | 67[1] |
| 2 | 1 | 750 | 20 | 0 | 78[2] | 181[2] | 259[2] | 23 | 39 | 62 | 76 |
| (Comparative) | 3 | 750 | 20 | 0 | 78 | 181 | 259 | 30 | 38 | 68 | 74 |
| Molyvan ® L | 4 | 750 | 20 | 0 | 78 | 181 | 259 | 27 | 42 | 69 | 73 |
| Added | 5 | 750 | 20 | 0 | 78 | 181 | 259 | 27 | 40 | 67 | 74 |
| | 6 | 750 | 20 | 0 | 78 | 181 | 259 | 27 | 41 | 68 | 74 |
| | 7 | 750 | 20 | 0 | 78 | 181 | 259 | 25 | 37 | 62 | 76 |
| | 8 | 750 | 20 | 0 | 78 | 181 | 259 | 26 | 39 | 65 | 75 |
| | 10 | 754 | 20 | 0 | 78 | 181 | 259 | 21 | 35 | 56 | 78 |
| | 11 | 750 | 20 | 0 | 78 | 181 | 259 | 23 | 38 | 61 | 76 |

[1]Result believed to be erroneous

[2]The (Ni + V) content of the feed of run 2 appears to be too low; this feed is essentially the same as the feed of run 1, but with Molyvan ® L added; thus the % removal of (Ni + V) may be somewhat higher than shown for run 2.

The data in Table IV, when read in view of footnote 2, shows that the dissolved molybdenum dithiophosphate (Molyvan ® L) was essentially as effective a demetallizing agent as $Mo(CO)_6$. Based upon these results, it is believed that the inventive additive is at least as effective a demetallizing agent as $Mo(CO)_6$.

EXAMPLE IVA

This example illustrates the rejuvenation of a substantially deactivated, sulfided, promoted desulfurization catalyst (referred to as catalyst D in Table I) by the addition of a decomposable Mo compound to the feed. The process was essentially in accordance with Example I except that the amount of Catalyst D was 10 cc. The feed was a supercritical Monagas oil extract containing about 29–35 ppm Ni, abut 103–113 ppm V, about 3.0–3.2 weight-% S and about 5.0 weight-% Ramsbottom carbon. LHSV of the feed was about 5.0 cc/cc catalyst/hr; the pressure was about 2250 psig; the hydrogen feed rate was about 1000 SCF $H_2$ per barrel of oil; and the reactor temperature was about 775° F. (413° C.). During the first 600 hours on stream, no Mo was added to the feed. Thereafter $Mo(CO)_6$ was added. Results are summarized in Table V.

TABLE V

| Hours on Stream | Feed Added Mo(ppm) | Ni (ppm) | V (ppm) | (Ni + V) (ppm) | Product Ni (ppm) | V (ppm) | (Ni + V) (ppm) | % Removal of (Ni + V) |
|---|---|---|---|---|---|---|---|---|
| 46 | 0 | 35 | 110 | 145 | 7 | 22 | 29 | 80 |
| 94 | 0 | 35 | 110 | 145 | 8 | 27 | 35 | 76 |
| 118 | 0 | 35 | 110 | 145 | 10 | 32 | 42 | 71 |
| 166 | 0 | 35 | 110 | 145 | 12 | 39 | 51 | 65 |
| 190 | 0 | 32 | 113 | 145 | 14 | 46 | 60 | 59 |
| 238 | 0 | 32 | 113 | 145 | 17 | 60 | 77 | 47 |
| 299 | 0 | 32 | 113 | 145 | 22 | 79 | 101 | 30 |
| 377 | 0 | 32 | 113 | 145 | 20 | 72 | 92 | 37 |
| 430 | 0 | 32 | 113 | 145 | 21 | 74 | 95 | 34 |
| 556 | 0 | 29 | 108 | 137 | 23 | 82 | 105 | 23 |
| 586 | 0 | 29 | 108 | 137 | 24 | 84 | 108 | 21 |
| 646 | 68 | 29 | 103 | 132 | 22 | 72 | 94 | 29 |
| 676 | 68 | 29 | 103 | 132 | 20 | 70 | 90 | 32 |
| 682 | 117 | 28 | 101 | 129 | 18 | 62 | 80 | 38 |
| 706 | 117 | 28 | 101 | 129 | 16 | 56 | 72 | 44 |
| 712 | 117 | 28 | 101 | 129 | 16 | 50 | 66 | 49 |
| 736 | 117 | 28 | 101 | 129 | 9 | 27 | 36 | 72 |

TABLE V-continued

| Hours on Stream | Feed Added Mo(ppm) | Feed Ni (ppm) | Feed V (ppm) | Feed (Ni + V) (ppm) | Product Ni (ppm) | Product V (ppm) | Product (Ni + V) (ppm) | % Removal of (Ni + V) |
|---|---|---|---|---|---|---|---|---|
| 742 | 117 | 28 | 101 | 129 | 7 | 22 | 29 | 78 |
| 766 | 117 | 28 | 101 | 129 | 5 | 12 | 17 | 87 |

The data in Table V shows that the demetallization activity of a substantially deactivated catalyst (removal of Ni+V after 586 hours: 21%) was dramatically increased (to about 87% removal of Ni+V) by the addition of $Mo(CO)_6$ for about 120 hours. At the time when the Mo addition commenced, the deactivated catalyst had a metal (Ni+V) loading of about 34 weight-% (i.e., the weight of the fresh catalyst had increased by 34% due to the accumulation of metals). At the conclusion of the test run, the metal (Ni+V) loading was about 44 weight-%. Sulfur removal was not significantly affected by the addition of Mo. Based on these results, it is believed that the addition of the inventive additive to the feed would also be beneficial in enhancing the demetallization activity of substantially deactivated catalysts.

While this invention has been described in detail for the purpose of illustration, it is not to be construed as limited thereby but is intended to cover all changes and modifications within the spirit and scope thereof.

That which is claimed is:

1. A composition comprising a mixture of at least one decomposable molybdenum compound selected from the group consisting of molybdenum dithiophosphates and molybdenum dithiocarbamates and at least one decomposable nickel compound selected from the group consisting of nickel dithiophosphates and nickel dithiocarbamates.

2. A composition in accordance with claim 1 wherein the atomic ratio of decomposable molybdenum compounds to decomposable nickel compounds in said mixture is in the range of about 1:1 to about 10:1.

3. A composition in accordance with claim 2 wherein said atomic ratio is about 4:1.

4. A composition in accordance with claim 1 wherein said decomposable molybdenum compound is a molybdenum dithiophosphate.

5. A composition in accordance with claim 4 wherein said molybdenum dithiophosphate is selected from the group having the following generic formulas:

$$Mo(S-\overset{\overset{\displaystyle S}{\|}}{\underset{\underset{\displaystyle OR_1}{|}}{P}}-OR_2)_n \qquad (1)$$

wherein n=3,4,5,6;$R_1$ and $R_2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or $R_1$ and $R_2$ are combined in one alkylene group of the structure

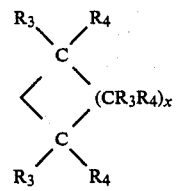

with $R_3$ and $R_4$ being independently selected from H, alkyl, cycloalkyl alkylcycloalkyl, aryl, alkylaryl and cycloalkylaryl groups as defined above, and x ranging from 1 to 10;

$$MoO_pS_q(S-\overset{\overset{\displaystyle S}{\|}}{\underset{\underset{\displaystyle OR_1}{|}}{P}}-OR_2)_r \qquad (2)$$

wherein p=0,1,2;q=0,1,2; (p+q)=1,2;

r=1,2,3,4 for (p+q)=1 and r=1,2 for (p+q)=2;

$$Mo_2O_tS_u(S-\overset{\overset{\displaystyle S}{\|}}{\underset{\underset{\displaystyle OR_1}{|}}{P}}-OR_2)_v \qquad (3)$$

wherein t=0,1,2,3,4;u=0,1,2,3,4;

(t+u)=1,2,3,4 v=4,6,8,10 for (t+u)=1;v=2,4,6,8 for (t+u)=2;

v=2,4,6 for (t+u)=3,v=2,4 for (t+u)=4.

6. A composition in accordance with claim 5 wherein said molybdenum dithiophosphate is oxymolybdenum (V) O,O'-di(2-ethylhexyl) phosphorodithioate.

7. A composition in accordance with claim 1 wherein said decomposable molybdenum compound is a molybdenum dithiocarbamate.

8. A composition in accordance with claim 7 wherein said molybdenum dithiocarbamate is selected from the group having the following generic formulas:

$$[Mo(S-\overset{\overset{\displaystyle S}{\|}}{C}-NR_1R_2)_n]_m, \qquad (4)$$

wherein n=3,4,5,6;m=1,2;$R_1$ and $R_2$ are either independently selected from H, alkyl groups having 1–20 carbon atoms, cycloalkyl groups having 3–22 carbon atoms and aryl groups having 6–25 carbon atoms; or $R_1$ and $R_2$ are combined in one alkylene group of the structure

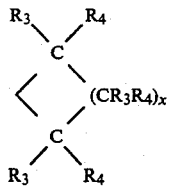

with $R_3$ and $R_4$ being independently selected from H, alkyl, cycloalkyl and aryl groups as defined above, and x ranging from 1 to 10;

$$MoO_pS_q(S-\overset{\overset{\displaystyle S}{\|}}{C}-NR_1R_2)_r \quad (5)$$

wherein $p=0,1,2; q=0,1,2; (p+q)=1,2;$
$r=1,2,3,4$ for $(p+q)=1$ and
$r=1,2$ for $(p+q)=2;$ $$Mo_2O_tS_u(S-\overset{\overset{\displaystyle S}{\|}}{C}-NR_1R_2)_v \quad (6)$$

wherein $t=0,1,2,3,4; u=0,1,2,3,4;$
$(t+u)=1,2,3,4$
$v=4,6,8,10$ for $(t+u)=1; v=2,4,6,8$ for $(t+u)=2;$
$v=2,4,6$ for $(t+u)=3, v=2,4$ for $(t+u)=4.$

9. A composition in accordance with claim 8 wherein said molybdenum dithiocarbamate is a molybdenum(V) di(tridecyl)dithiocarbamate.

10. A composition in accordance with claim 1 wherein said decomposable nickel compound is a nickel dithiophosphate.

11. A composition in accordance with claim 10 wherein said nickel dithiophosphate has the following generic formula:

$$Ni(S-\overset{\overset{\displaystyle S}{\|}}{\underset{\underset{\displaystyle OR_1}{|}}{P}}-OR_2)_2$$

wherein $R_1$ and $R_2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or $R_1$ and $R_2$ are combined in one alkylene group of the structure

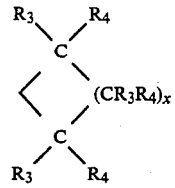

with $R_3$ and $R_4$ being independently selected from H, alkyl, cycloalkyl alkylcycloalkyl, aryl, alkylaryl and cycloalkyaryl groups as defined above, and x ranging from 1 to 10.

12. A composition in accordance with claim 11 wherein said nickel dithiophosphate is a nickel (II) O,O'-diamylphosphorodithioate.

13. A composition is accordance with claim 1 wherein said decomposable nickel compound is a nickel dithiocarbamate.

14. A composition in accordance with claim 13 wherein said nickel dithiocarbamate has the following generic formula:

$$Ni(S-\overset{\overset{\displaystyle S}{\|}}{C}-NR_1R_2)_2$$

wherein $R_1$ and $R_2$ are either independently selected from H, alkyl groups having 1–20 carbon atoms, cycloalkyl groups having 3–22 carbon atoms and aryl groups having 6–25 carbon atoms; or $R_1$ and $R_2$ are combined in one alkylene group of the structure

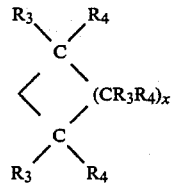

with $R_3$ and $R_4$ being independently selected from H, alkyl, cycloalkyl and aryl groups as defined above, and x ranging from 1 to 10.

15. A composition in accordance with claim 14 wherein said nickel dithiocarbamate is a nickel (II) diamyldithiocarbamate.

* * * * *